US009829901B2

(12) United States Patent
Watanabe et al.

(10) Patent No.: US 9,829,901 B2
(45) Date of Patent: Nov. 28, 2017

(54) REFERENCE VOLTAGE GENERATION CIRCUIT

(71) Applicant: Torex Semiconductor Ltd., Tokyo (JP)

(72) Inventors: Kenichi Watanabe, Tokyo (JP); Norimasa Hane, Tokyo (JP)

(73) Assignee: Torex Semiconductor Ltd., Tokyo (JP)

( * ) Notice: Subject to any disclaimer, the term of this patent is extended or adjusted under 35 U.S.C. 154(b) by 0 days.

(21) Appl. No.: 15/298,716

(22) Filed: Oct. 20, 2016

(65) Prior Publication Data

US 2017/0115679 A1 Apr. 27, 2017

(30) Foreign Application Priority Data

Oct. 21, 2015 (JP) ..... 2015-207117

(51) Int. Cl.
*G05F 1/10* (2006.01)
*G05F 3/02* (2006.01)
*G05F 1/575* (2006.01)

(52) U.S. Cl.
CPC ..... *G05F 1/575* (2013.01)

(58) Field of Classification Search
CPC ..... G05F 1/465; G05F 3/262; G05F 3/247; G05F 3/24; G11C 5/147
USPC ..... 327/512–513, 538, 540, 541
See application file for complete search history.

(56) References Cited

U.S. PATENT DOCUMENTS 6,087,821 A * 7/2000 Kojima ..... G05F 3/262 323/315
7,593,281 B2 * 9/2009 Pyeon ..... G11C 5/147 365/189.11
2002/0086474 A1 7/2002 Tonda et al.
2008/0116862 A1 * 5/2008 Yang ..... G05F 1/575 323/269
2008/0297132 A1 12/2008 Aota
2009/0072893 A1 * 3/2009 Hirota ..... G11C 16/30 327/540
2015/0309528 A1 * 10/2015 Igarashi ..... G05F 5/00 323/303

FOREIGN PATENT DOCUMENTS

JP 2002170391 A 6/2002
JP 200438540 A 2/2004
JP 2008293409 A 12/2008
JP 2013161258 A 8/2013
JP 2014186718 A 10/2014

* cited by examiner

*Primary Examiner* — Quan Tra
(74) *Attorney, Agent, or Firm* — The Webb Law Firm

(57) ABSTRACT

Each of a plurality of reference voltage sources having different temperature characteristics has a reference voltage generation unit which generates a predetermined reference voltage having intrinsic temperature characteristics showing a peak voltage at different temperatures, an amplification circuit which compares the reference voltage and a feedback voltage to control an output transistor, the output transistor which generates a reference output voltage at an output terminal, and a voltage regulation unit which is able to regulate an output voltage so as to become the reference output voltage and generates the feedback voltage. A maximum reference output voltage which is the maximum of the reference output voltages is output through the output terminal.

7 Claims, 6 Drawing Sheets

REFERENCE VOLTAGE GENERATION CIRCUIT

CROSS-REFERENCE TO RELATED APPLICATION

This application claims priority to Japanese Patent Application No. 2015-207117 filed Oct. 21, 2015, the disclosure of which is hereby incorporated in its entirety by reference.

BACKGROUND OF THE INVENTION

Field of the Invention

The present invention relates to a reference voltage generation circuit, and in particular, is useful when applied to a voltage source driving a semiconductor product being used in a wide temperature range.

Background Art

In recent years, an operating temperature range (for example, −50° C. to 150° C.) required for a semiconductor product tends to expand, and in a reference voltage generation circuit of the related art which regulates a reference output voltage with a normal temperature as 25° C., there is a problem in that a predetermined reference output voltage cannot be obtained with high precision and stably in a wide temperature range. In particular, whereas a reference output voltage of a semiconductor product for a power supply requires flat temperature characteristics in a wide temperature range, in a regulator, a switching power supply, or the like, a temperature inside an IC becomes a high temperature due to heat generation or the like. As a result, in the reference voltage generation circuit of the related art, there is a problem in that load stability is deteriorated.

JP-A-2013-161258, JP-A-2014-186714, JP-A-2008-293409 suggest a reference voltage generation circuit which is contrived such that flat temperature characteristics are obtained.

While the technique described in JP-A-2013-161258 is intended to output low power with a small minimum operation voltage and to obtain flat temperature characteristics arbitrarily, basically, since flat temperature characteristics in a predetermined range are obtained by one reference voltage source, it is not sufficient for making temperature characteristics flat in a wide temperature range of, for example, −50° C. to 100° C.

JP-A-2014-186714 relates to a technique contrived such that, even if variation exists in a manufacturing process, flat temperature characteristics can be obtained. However, since a reference voltage generation circuit disclosed in JP-A-2014-186714 forms a plurality of unit reference voltage generation circuits in parallel, and then, selects a unit reference voltage generation circuit having the flattest temperature characteristics among a plurality of unit reference voltage generation circuits, the remaining unit reference voltage generation circuits have to be discarded, causing deterioration of yield. Also, the temperature characteristics are not essentially different from those in a case where the reference voltage generation circuit is formed of one reference voltage source, and sufficient flattening of the temperature characteristics in a wide range cannot be implemented.

JP-A-2008-293409 relates to a technique contrived so as to reduce variation in reference voltage due to process fluctuation, temperature fluctuation, and power supply voltage fluctuation. However, like JP-A-2013-161258, since JP-A-2008-293409 relates to a technique contrived such that flat temperature characteristics in a predetermined range are obtained by one reference voltage source, it is not sufficient for making the temperature characteristics flat in a wide temperature range.

SUMMARY OF THE INVENTION

An object of the invention is to provide a reference voltage generation circuit capable of obtaining flat temperature characteristics in a sufficiently wide temperature range in consideration of the related art.

A first aspect of the invention attaining the above-described object is a reference voltage generation circuit which is formed by combining a plurality of reference voltage sources having different temperature characteristics representing output voltage characteristics with respect to environmental temperature. Each of the reference voltage sources has a reference voltage generation unit, an amplification circuit, an output transistor, a voltage regulation unit, and an output terminal, the reference voltage generation unit generates a predetermined reference voltage having intrinsic temperature characteristics showing a peak voltage at different temperatures, the amplification circuit compares the reference voltage with a feedback voltage fed back from the voltage regulation unit and controls the output transistor such that both of the reference voltage and the feedback voltage coincide with each other, the output transistor is connected to the output terminal to control an output voltage generated at the output terminal, the voltage regulation unit is connected to the output terminal, the output voltage is formed regulatably so as to become a predetermined reference output voltage, and a voltage detected by the voltage regulation unit is set as the feedback voltage, and the output terminals are collectively connected to one common output terminal, and a maximum reference output voltage which is a maximum voltage among the respective reference output voltages is configured to be obtained at the common output terminal.

According to this aspect, the predetermined reference output voltage having intrinsic temperature characteristics showing a peak voltage at different temperatures can be generated at the output terminal by regulation in the voltage regulation unit based on the reference voltages generated by the respective reference voltage generation units. In addition, the maximum reference output voltage which is the maximum of the respective reference output voltages can be output through the common output terminal. Here, the maximum reference output voltage has characteristics in which voltage decreases in the regions of both end portions of respective temperature characteristics having both end portions tending to decrease in a single reference voltage source are replaced with a larger reference output voltage of a different reference voltage source. As a result, the temperature characteristics of the final maximum reference output voltage of the reference voltage generation circuit can have flat characteristics in a wide temperature range in which the temperature ranges of the respective temperature characteristics of the respective reference voltage generation units are superimposed.

According to a second aspect of the invention, in the reference voltage generation circuit described in the first aspect, the reference voltage generation unit has a constant current generation unit and a constant voltage generation unit, the constant current generation unit is formed by connecting in series a saturation-connected first MOS transistor and a depletion type second MOS transistor having a gate and a source connected to each other, the constant voltage generation unit connects in series a third MOS transistor mirror-connected to the first MOS transistor and a fourth MOS transistor doubling as the amplification circuit to generate the reference voltage with the gate-source voltage of the fourth MOS transistor, the output transistor is formed of a fifth MOS transistor having a gate connected between the third MOS transistor and the fourth MOS transistor to become a source follower with respect to the constant voltage generation unit, and the voltage regulation unit is configured to supply the feedback voltage to a gate of the fourth MOS transistor.

According to this aspect, the predetermined reference voltage is obtained with the voltage specified as the gate-source voltage of the fourth MOS transistor by the constant voltage generation unit based on the constant current generated by the constant current generation unit of each reference voltage generation circuit. Here, the predetermined voltage detected in a state where the output terminal is regulated so as to become the predetermined reference output voltage is supplied from the voltage regulation unit to the fourth MOS transistor as the feedback voltage, and controls the output of the output transistor which becomes the source follower. As a result, the predetermined reference output voltage having intrinsic temperature characteristics is stably generated at each output terminal based on the reference voltage generated by each constant voltage generation unit.

According to a third aspect of the invention, in the reference voltage generation circuit according to the second aspect, the constant current generation unit is formed in common for the respective constant voltage generation units by mirror-connecting the first MOS transistor in common to the third MOS transistors of the constant voltage generation units.

According to this aspect, the constant current generation unit can be shared by a plurality of constant voltage generation units. As a result, it is possible to not only achieve reduction in the number of parts or current consumption in the constant current generation unit, but also easily arrange the characteristics of the constant current generation unit.

According to a fourth aspect of the invention, in the reference voltage generation circuit according to the second or third aspect, the voltage regulation unit has one end connected to the output transistor and the output terminal, is constituted by connecting a plurality of resistive elements in series, and is formed in common for the respective constant voltage generation units and the respective output transistors by being constituted to supply the feedback voltage specified by a division ratio of the resistive elements to a gate of a fourth MOS transistor in a state where the reference output voltage is regulated so as to be generated at the output terminal.

According to this aspect, the voltage regulation unit can be shared by a plurality of reference voltage sources. As a result, it is possible to not only achieve reduction in the number of parts or current consumption in the voltage regulation unit, but also easily arrange the characteristics of the voltage regulation unit.

According to a fifth aspect of the invention, in the reference voltage generation circuit according to any one of the second to fourth aspects, a switching element is connected in series with the output transistor and configured to selectively operate the output transistor.

According to this aspect, the output transistor to be operated can be selected by switching the ON/OFF states of the switching element. As a result, it is possible to individually and easily perform the regulation in the predetermined reference output voltage in the voltage regulation unit for each constant voltage generation unit.

According to the invention, the temperature characteristics of the maximum reference output voltage obtained from the common output terminal of the reference voltage generation circuit can have flat characteristics in a wide temperature range in which the temperature ranges of the respective temperature characteristics of the respective reference voltage generation units are superimposed.

DETAILED DESCRIPTION OF THE INVENTION

Figure 1:
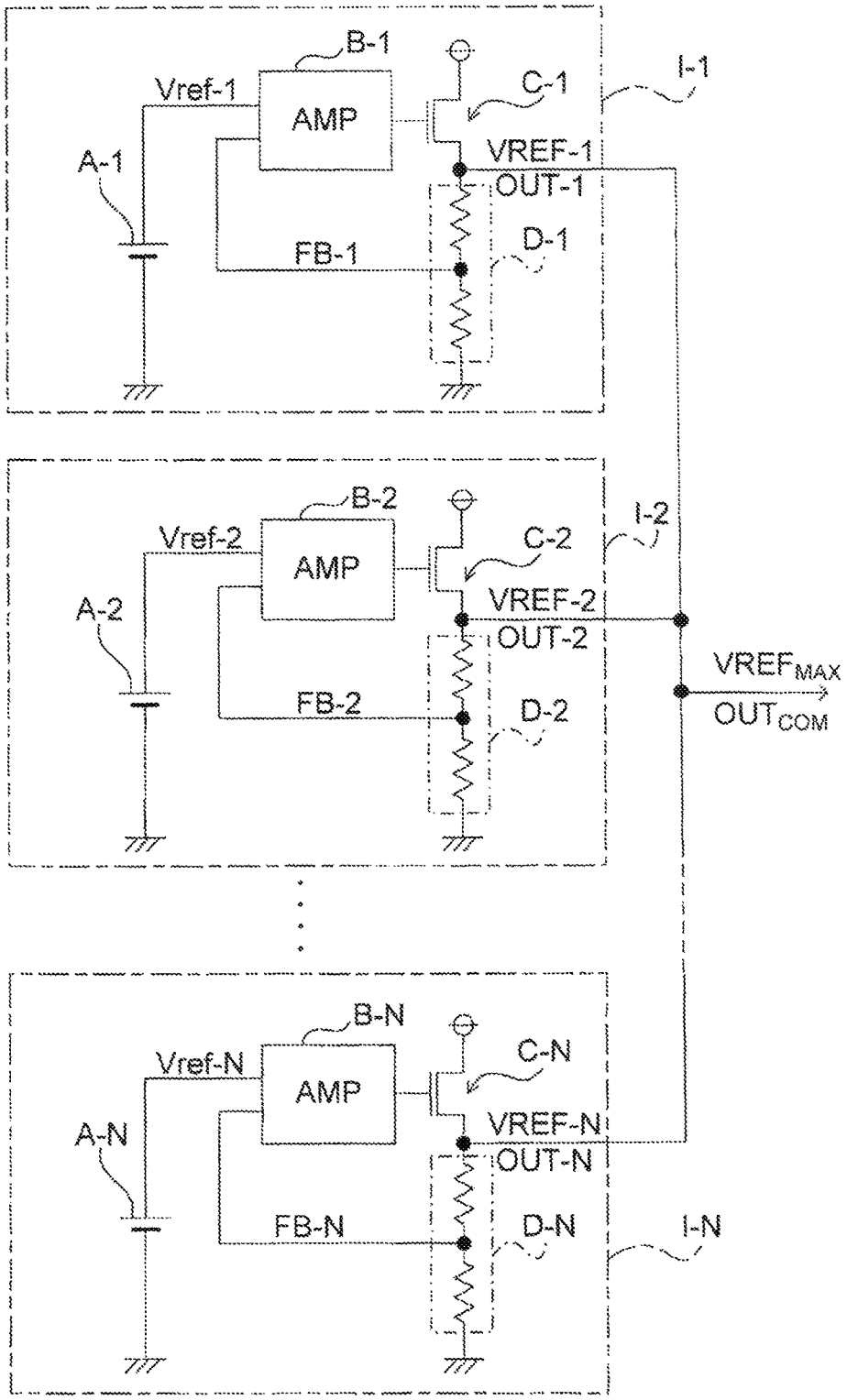
FIG. 1 is a block diagram showing a reference voltage generation circuit according to the invention.

FIG. 1 is a block diagram showing a reference voltage generation circuit of the invention. As shown in the drawing, the reference voltage generation circuit according to the invention is formed by combining a plurality of reference voltage sources I-1, I-2, . . . , and I-N (where N is a natural number) having different temperature characteristics representing output voltage characteristics with respect to environmental temperature.

The reference voltage sources I-1, I-2, . . . , and I-N respective have reference voltage generation units A-1, A-2, . . . , and A-N, amplification circuits B-1, B-2, . . . , and B-N, output transistors C-1, C-2, . . . , and C-N, voltage regulation units D-1, D-2, . . . , and D-N, and output terminals OUT-1, OUT-2, . . . , and OUT-N.

The reference voltage generation units A-1, A-2, . . . , and A-N respectively generate predetermined reference voltages Vref-1, Vref-2, . . . , and Vref-N having intrinsic temperature characteristics showing a peak at different temperatures. The reference voltages Vref-1, Vref-2, . . . , and Vref-N become one input of the amplification circuits B-1, B-2, . . . , and B-N. Predetermined feedback voltages FB-1, FB-2, . . . , and FB-N are supplied from the voltage regulation units D-1, D-2, . . . , and D-N to the other input of the amplification circuits B-1, B-2, . . . , and B-N. The voltage regulation units D-1, D-2, . . . , and D-N regulate the voltages of the output terminals OUT-1, OUT-2, . . . , and OUT-N which are controlled through the output transistors C-1, C-2, . . . , and C-N so as to become the predetermined reference output voltages VREF-1, VREF-2, . . . , and VREF-N, and feed back the feedback voltages FB-1, FB-2, . . . , and FB-N giving the reference output voltages VREF-1, VREF-2, . . . , and VREF-N to the amplification circuits B-1, B-2, . . . , and B-N. As a result, the output transistors C-1, C-2, . . . , and C-N are controlled with the outputs of the amplification circuits B-1, B-2, . . . , and B-N, and the output terminals OUT-1, OUT-2, . . . , and OUT-N are maintained at the predetermined reference output voltages VREF-1, VREF-2, . . . , and VREF-N. The N output terminals OUT-1, OUT-2, . . . , and OUT-N are connected in parallel and combined to one common output terminal $OUT_{COM}$. Accordingly, a maximum reference output voltage $VREF_{MAX}$ which is a maximum voltage among the reference output voltages VREF-1, VREF-2, . . . , and VREF-N is output to the common output terminal $OUT_{COM}$.

In this way, in the invention, the N reference voltage sources I-1, I-2, . . . , and I-N are connected in parallel to form the reference voltage generation circuit, and even if the reference voltages Vref-1, Vref-2, . . . , and Vref-N generated by the respective reference voltage generation units A-1, A-2, . . . , and A-N of the respective reference voltage sources I-1, . . . , and I-N are different, the reference output voltages VREF-1, VREF-2, . . . , and VREF-N matching a predetermined reference are generated at the output terminals OUT-1, OUT-2, . . . , and OUT-N through the output transistors C-1, C-2, . . . , and C-N by regulation in the voltage regulation units D-1, D-2, . . . , and D-N. The reference output voltages VREF-1, VREF-2, . . . , and VREF-N have intrinsic temperature characteristics reflecting temperature characteristics of the reference voltages Vref-1, Vref-2, . . . , and Vref-N. Accordingly, the maximum reference output voltage $VREF_{MAX}$ obtained by selecting the maximum of the reference output voltages VREF-1, VREF-2, . . . , and VREF-N from among the reference output voltages VREF-1, VREF-2, . . . , and VREF-N along a temperature distribution has flat temperature characteristics in a wide temperature range.

Figure 2:
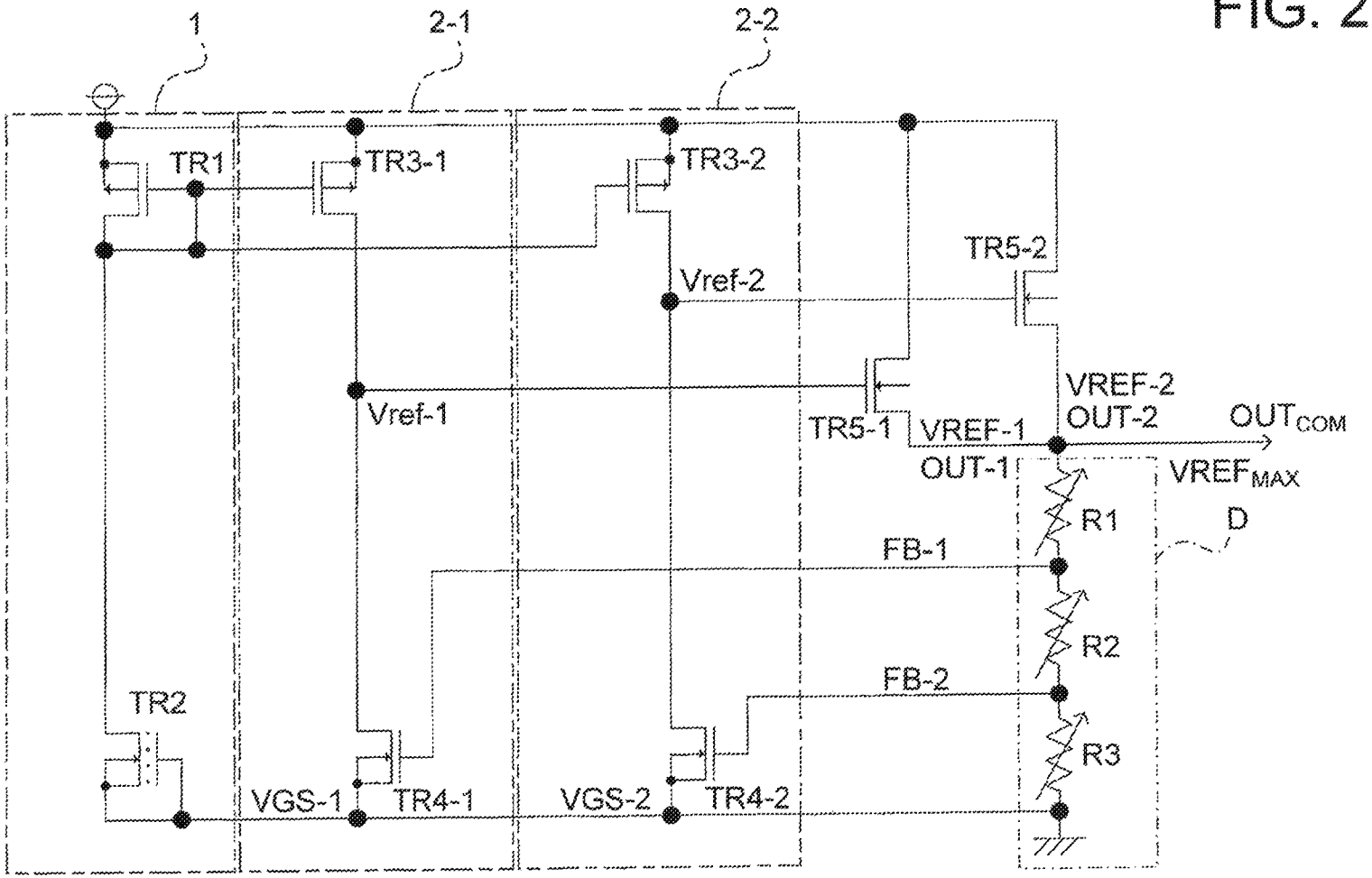
FIG. 2 is a circuit diagram showing a reference voltage generation circuit according to a first embodiment of the invention.

Next, an embodiment of a specific configuration of the reference voltage generation circuit will be described. FIG. 2 is a circuit diagram showing a reference voltage generation circuit according to a first embodiment of the invention. As shown in the drawing, this embodiment relates to a case where the reference voltage generation unit A shown in FIG. 1 has a two-stage structure. In more detail, one reference voltage generation unit A-1 (see FIG. 1; the same applies to the following) is formed of a constant current generation unit 1 and a constant voltage generation unit 2-1, and another reference voltage generation unit A-2 (see FIG. 1; the same applies to the following) is formed of the constant current generation unit 1 and a constant voltage generation unit 2-2. That is, in this embodiment, the constant voltage generation unit 1 is shared by the two reference voltage generation units A-1 and A-2. With this sharing, it is possible to not only achieve reduction in the number of parts of the elements constituting the constant current generation unit 1 or current consumption, but also easily arrange the characteristics of the constant current generation unit 1. However, this configuration is not essential.

The constant current generation unit 1 is formed by connecting in series a saturation-connected first MOS transistor TR1 and a depletion type second MOS transistor TR2 with a gate and a source connected to each other. The constant voltage generation unit 2-1 connects in series a third MOS transistor TR3-1 mirror-connected to the first MOS transistor TR1 and a fourth MOS transistor TR4-1 doubling as the amplification circuit B (see FIG. 1; the same applies to the following) to generate reference voltage Vref-1 with a gate-source voltage VGS-1 of the fourth MOS transistor TR4-1. Similarly, the constant voltage generation unit 2-2 connects in series a third MOS transistor TR3-2 mirror-connected to the first MOS transistor TR1 and a fourth MOS transistor TR4-2 doubling as the amplification circuit B (see FIG. 1) to generate a reference voltage Vref-2 with a gate-source voltage VGS-2 of the fourth MOS transistor TR4-2.

The reference voltages Vref-1 and Vref-2 have intrinsic temperature characteristics showing a peak voltage at different temperatures. In this embodiment, the peak voltage of the reference voltage Vref-1 is set to have temperature characteristics showing a peak at a temperature lower than the peak voltage of the reference voltage Vref-2. Such setting can be arbitrarily set by selecting the W/L (W=channel width of MOS transistor, L=length of channel) of the fourth MOS transistors TR4-1 and TR4-2.

A fifth MOS transistor TR5-1 which becomes the output transistor of the reference voltage source I-1 (see FIG. 1; the same applies to the following) has a gate connected between the third MOS transistor TR3-1 and the fourth MOS transistor TR4-1, and a source connected to the output terminal OUT-1 so as to become a source follower to the constant voltage generation unit 2-1. Similarly, a fifth MOS transistor TR5-2 which becomes the output transistor of the different reference voltage source I-2 (see FIG. 1; the same applies to the following) has a gate connected between the third MOS transistor TR3-2 and the fourth MOS transistor TR4-2, and has a source connected to the output terminal OUT-2 so as to become a source follower to the constant voltage generation unit 2-2. The output terminals OUT-1 and OUT-2 of the respective reference voltage sources I are connected in parallel and combined to one common output terminal $OUT_{COM}$. As a result, the maximum reference output voltage $VREF_{MAX}$ which is the maximum of the reference output voltages VREF-1 and VREF-2 is generated at the common output terminal $OUT_{COM}$.

In a case where a plurality of stages of reference voltage sources I are connected in parallel, a plurality of kinds of reference output voltages VREF output by the output transistors C need to match a predetermined reference. That is, in this embodiment, since the reference voltage sources I have a two-stage structure, the two kinds of reference output voltages VREF-1 and VREF-2 are generated. Accordingly, the reference output voltage VREF-1 output by the fifth MOS transistor TR5-1 is set to have characteristics showing a maximum value at low temperature, and the reference voltage VREF-2 output by the fifth MOS transistor TR5-2 is set to have characteristics showing a maximum value at high temperature. That is, the W/L of the fourth MOS transistors TR4-1 and TR4-2 needs to be set as appropriate, and the reference output voltages VREF-1 and VREF-2 need to be regulated so as to become the same value such that the respective temperature characteristic curves intersect each other at a predetermined temperature (in this embodiment, 25° C.). The voltage regulation unit D performs such regulation.

Accordingly, the voltage regulation unit D has one end connected to the output terminals OUT-1 and OUT-2 and the other end grounded, and the output voltages of the fifth MOS transistors TR5-1 and TR5-2 as the output transistor are formed regulatably so as to respectively become the predetermined reference output voltages VREF-1 and VREF-2. Then, voltages detected by the voltage regulation unit D are fed back to the fourth MOS transistors TR4-1 and TR4-2 as the feedback voltages FB-1 and FB-2.

In addition, the voltage regulation unit D in this embodiment is constituted by connecting a plurality (in this embodiment, three) of resistive elements R1, R2, and R3 in series, and is configured to respectively supply the feedback voltages FB-1 and FB-2 specified by a division ratio of the resistive elements R1, R2, and R3 to the gates of the fourth MOS transistors TR4-1 and TR4-2 in a state where the reference output voltages VREF-1 and VREF-2 are regulated so as to be generated. That is, in this embodiment, the voltage regulation unit D is shared by the two reference voltage sources I. With this sharing, it is possible to not only achieve reduction in current consumption in the voltage regulation unit D, but also easily arrange the characteristics of the voltage regulation unit D. However, this configuration is not essential. As in this embodiment, a determination method of the division ratio of the resistive elements R1, R2, and R3 in a case where one voltage regulation unit D is formed will be described below in detail.

According to this embodiment, the two kinds of reference output voltages VREF-1 and VREF-2 having intrinsic temperature characteristics showing a peak voltage at different temperatures can be generated at the output terminals OUT-1 and OUT-2 by regulation in the voltage regulation unit D based on the reference voltages Vref-1 and Vref-2 generated by the respective constant voltage generation units 2-1 and 2-2, and the maximum reference output voltage $VREF_{MAX}$ which is the maximum of the reference output voltages VREF-1 and VREF-2 can be selectively output to the common output terminal $OUT_{COM}$. That is, in this embodiment, since the two stages of reference voltage sources I-1 and I-2 are provided, as shown in the temperature characteristics of FIG. 3, the maximum reference output voltage $VREF_{MAX}$ has temperature characteristics in which two kinds of temperature characteristics showing a peak voltage at different temperatures are superimposed.

Figure 3:
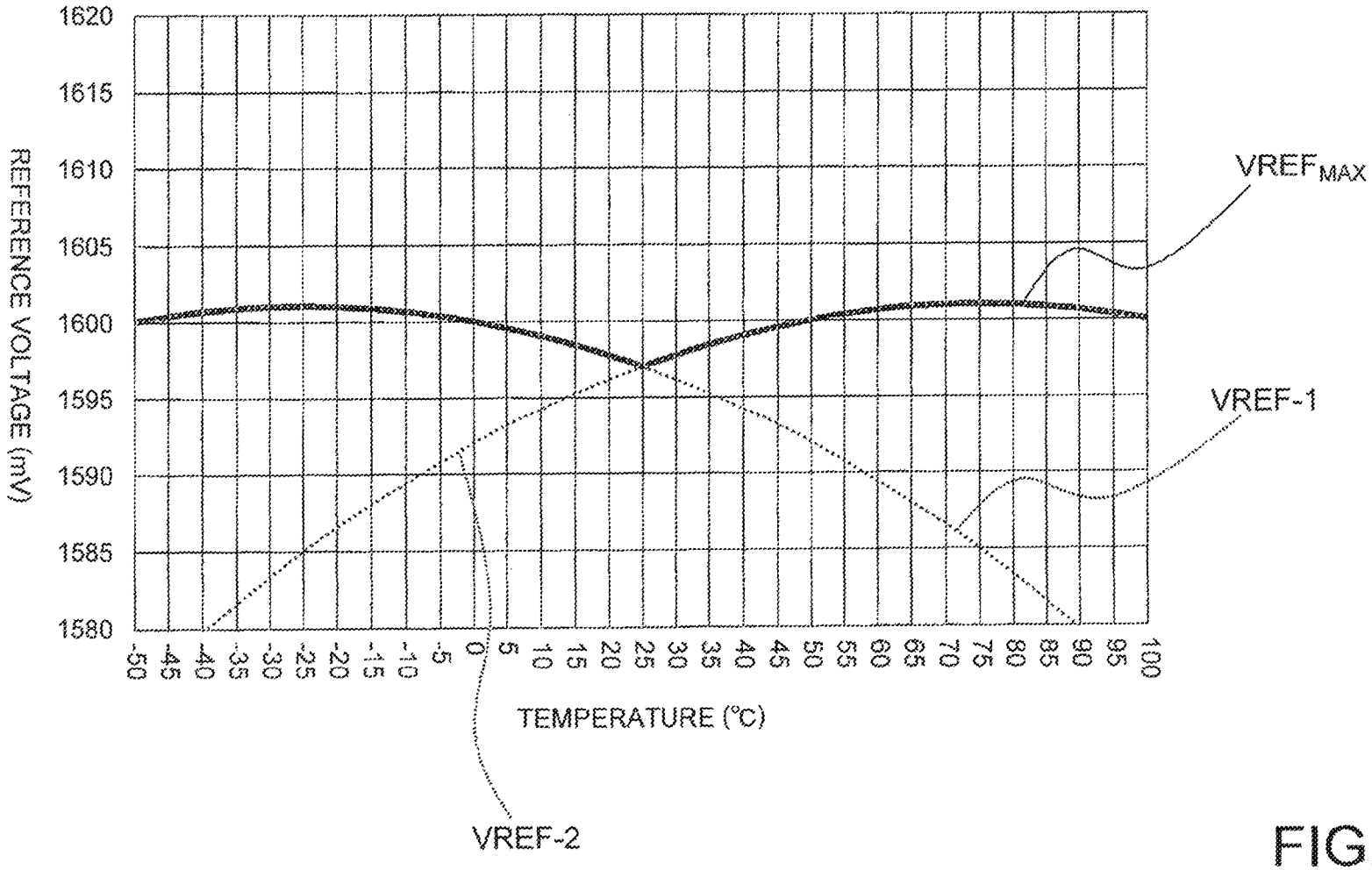
FIG. 3 is a characteristic diagram showing temperature characteristics of the reference voltage generation circuit shown in FIG. 2.

As a result, in this embodiment, a larger reference output voltage of the two kinds of reference output voltages VREF-1 and VREF-2 having the end portions tending to decrease as indicated by a dotted line in FIG. 3 in the single reference voltage source I can be selected. For this reason, the maximum reference output voltage $VREF_{MAX}$ indicated by a thick line in FIG. 3 has characteristics in which voltage decreases in the regions of both end portions of the temperature characteristics of the single reference output voltages VREF-1 and VREF-2 is replaced with different larger reference output voltages VREF-1 and VREF-2. As a result, the temperature characteristics of the maximum reference output voltage $VREF_{MAX}$ which is a final output voltage obtained through the common output terminal $OUT_{COM}$ can have flat characteristics in a wide temperature range in which the temperature ranges of the respective reference voltages VREF-1 and VREF-2 of the respective reference voltage generation units I are superimposed.

Figure 4:
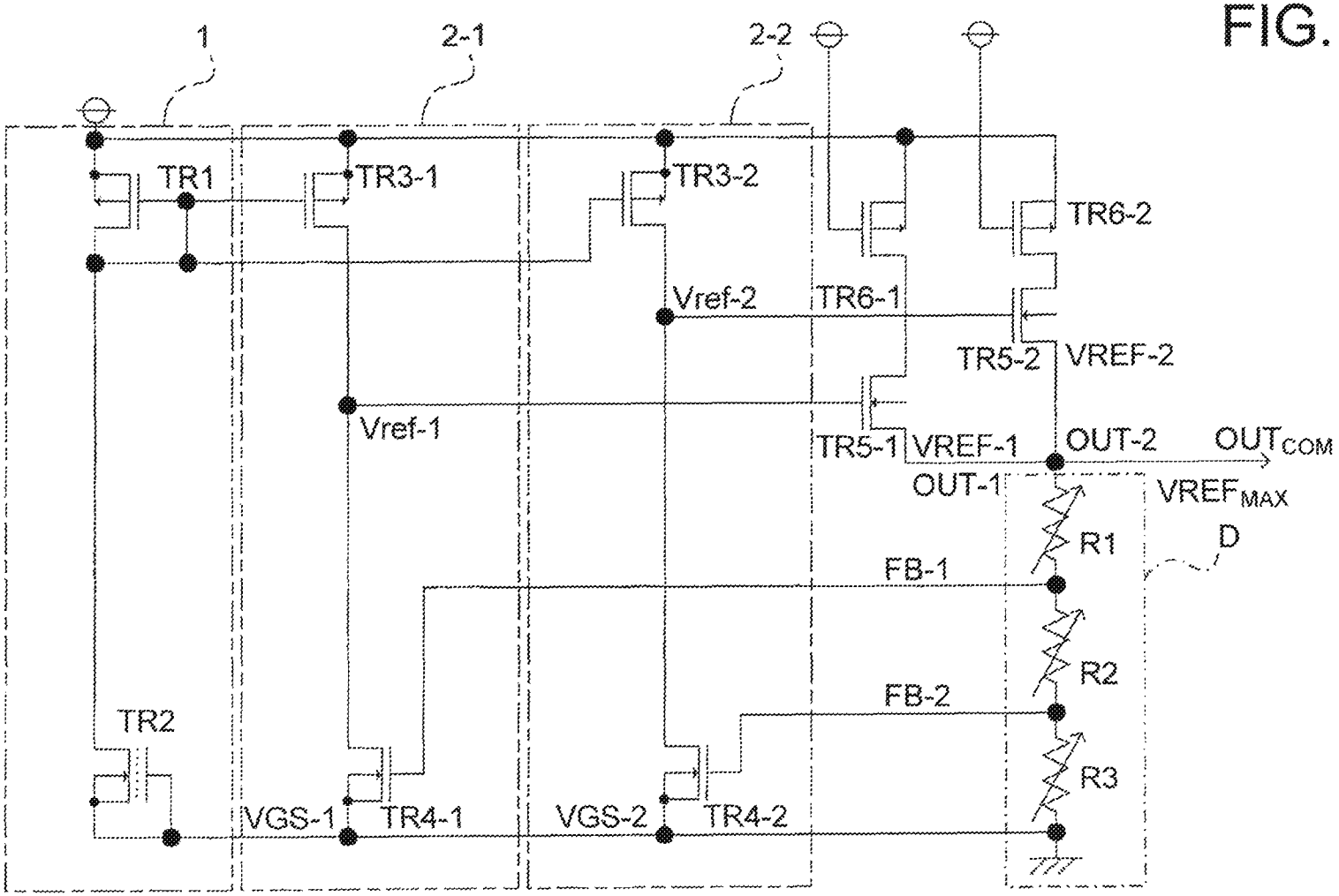
FIG. 4 is a circuit diagram showing a reference voltage generation circuit according to a second embodiment of the invention.

FIG. 4 is a circuit diagram showing a reference voltage generation circuit according to a second embodiment of the invention. As shown in the drawing, the reference voltage generation circuit according to this embodiment is contrived such that regulation of the reference voltages Vref-1 and Vref-2 by regulation of the resistance values of the resistive elements R1 to R3 can be performed easily and reasonably by connecting MOS transistors TR6-1 and TR6-2 as switching elements in series with the MOS transistors TR5-1 and TR5-2 as the output transistors and combining the ON/OFF states of the MOS transistors TR6-1 and TR6-2. In this embodiment, other portions are the same as those of the reference voltage generation circuit shown in FIG. 2 excluding that the MOS transistors TR6-1 and TR6-2 as the switching elements are added. Accordingly, the same portions are represented by the same reference numerals, and overlapping description will not be repeated.

As described above, according to this embodiment, the MOS transistors TR5-1 and TR5-2 as the output transistors to be operated can be selected by a combination of the ON/OFF states of the MOS transistors TR6-1 and TR6-2 as the switching elements. As a result, regulation of the reference output voltages VREF-1 and VREF-2 based on the division ratio of the resistive elements R1 to R3 in the voltage regulation unit D can be performed individually and easily for each of the constant voltage generation units 2-1 and 2-2. Specifically, a regulation operation having the following procedures is executed. In a case of regulating the reference output voltage VREF-1, the MOS transistor TR6-1 is brought into the ON state, and the MOS transistor TR6-2 is brought into the OFF state. In a case of regulating the reference output voltage VREF-2, the MOS transistor TR6-1 is brought into the OFF state, and the MOS transistor TR6-2 is brought into the ON state.

In order to further simplify the calculation procedure, it is supposed that the resistance values of the resistive elements R1 and R2 before regulation are sufficiently small. For example, it is considered as a state of being short-circuited by a fuse.

<Procedure 1>

The resistance values are regulated so as to become R1+R2={R3×(target value−initial value 2)/initial value 2}. This can be satisfactorily performed, for example, by trimming processing of the resistive elements R1 to R3. The target value is, for example, a voltage of VREF-2 at 25° C., and the initial value 2 is a measured value of VREF2 before regulation.

<Procedure 2>

The resistance values are regulated so as to become R2=[{(R1+R2+R3)×initial value 1/target value}−R3]. This can be satisfactorily performed, for example, by trimming processing of the resistive elements R1 to R3. The initial value 1 is a measured value of VREF-1 before regulation.

<Procedure 3>

The resistance values are regulated so as to become R1={(R1+R2)−R2}. This is also performed by the same trimming processing as Procedures 1 and 2.

Figure 5:
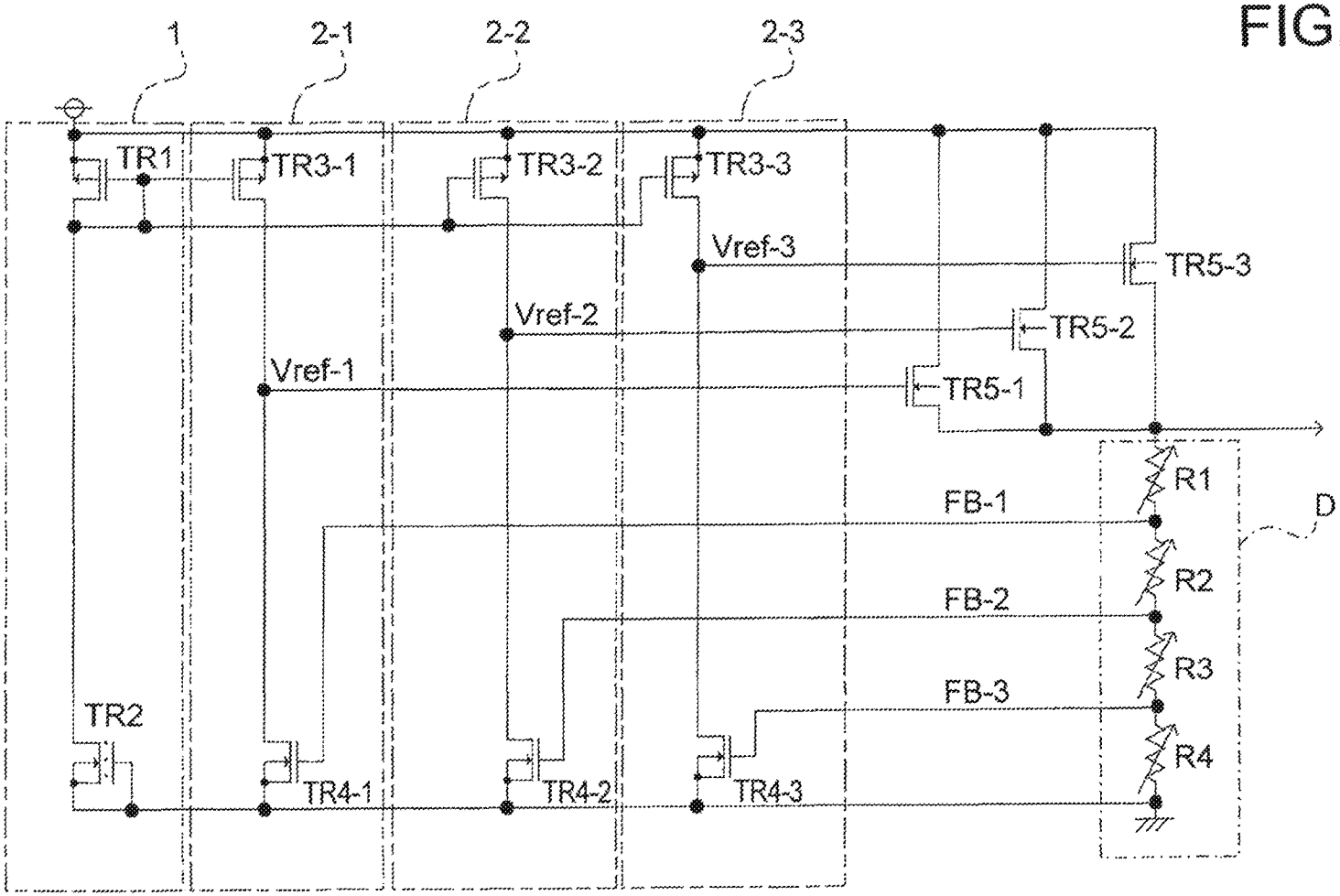
FIG. 5 is a circuit diagram showing a reference voltage generation circuit according to a third embodiment of the invention.

FIG. 5 is a circuit diagram showing a reference voltage generation circuit according to a third embodiment of the invention. As shown in the drawing, the reference voltage generation circuit according to this embodiment has three stages of reference voltage sources I-1, I-2, and I-3 (see FIG. 1). Accordingly, a constant voltage generation unit 2-3 is added to the reference voltage generation circuit shown in FIG. 2, and a MOS transistor TR5-3 which is an output transistor corresponding to the constant voltage generation unit 2-3 is added. Furthermore, in order to generate a feedback voltage FB-3 and a reference output voltage VREF-3, a resistive element R4 is added to the voltage regulation unit D.

The constant voltage generation unit 2-3 in this embodiment connects in series a third MOS transistor TR3-3 mirror-connected to the first MOS transistor TR1 and a fourth MOS transistor TR4-3 doubling as the amplification circuit B (see FIG. 1) to generate a reference voltage Vref-3 with a gate-source voltage VGS-3 of the fourth MOS transistor TR4-3. The MOS transistor TR5-3 which becomes the output transistor has a gate connected between the third MOS transistor TR3-3 and the fourth MOS transistor TR4-3, and becomes a source follower to the constant voltage generation unit 2-3 to generate a predetermined reference output voltage VREF3 at an output terminal OUT-3. The reference output voltage VREF3 matches a predetermined reference by regulation in the voltage regulation unit D, and is generated so as to have intrinsic temperature characteristics showing a peak at a predetermined temperature.

Though not shown in FIGS. 2, 4, and 5, actually, cascode circuits are incorporated in the constant current generation unit and the constant voltage generation units 2-1 to 2-3, and fluctuation of a power supply voltage is suppressed by each cascode circuit.

Figure 6:
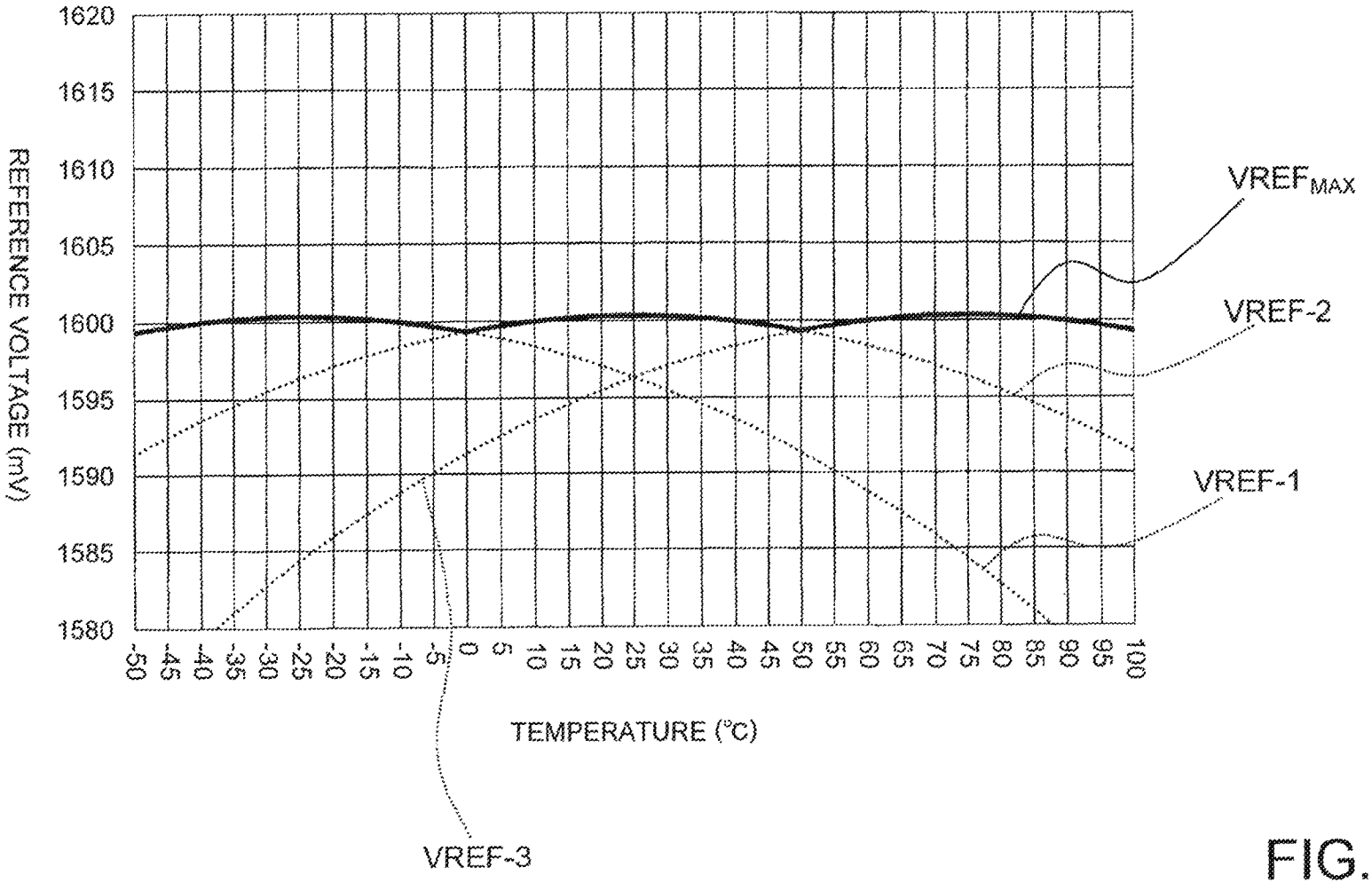
FIG. 6 is a characteristic diagram showing temperature characteristics of the reference voltage generation circuit shown in FIG. 5.

In this embodiment described above, the three kinds of reference output voltages VREF-1 to VREF-3 having intrinsic temperature characteristics showing a peak at different temperatures are generated at the output terminals OUT-1 to OUT-3. As a result, the maximum reference output voltage $VREF_{MAX}$ which is the maximum voltage of the reference output voltages VREF-1 to VREF-3 selected along the temperature distribution is generated at the common output terminal $OUT_{COM}$. The maximum reference output voltage $VREF_{MAX}$ has characteristics indicated by a thick line in FIG. 6. As will be apparent referring to the drawing, the temperature characteristics of the maximum reference output voltage $VREF_{MAX}$ become characteristics in which the decrease portions of the temperature characteristics of the reference output voltage VREF-1 and the reference output voltage VREF-3 are complemented by the temperature characteristics of the reference output voltage VREF-2. Accordingly, it is possible to obtain flatter temperature characteristics compared to a case of the two stages of reference voltage sources I-1 and I-2 shown in FIG. 2.

The invention can be effectively used in an industrial field of manufacturing a semiconductor device or the like requiring a stable reference constant voltage.

What is claimed is:

1. A reference voltage generation circuit formed by combining a plurality of reference voltage sources having different temperature characteristics representing output voltage characteristics with respect to environmental temperature, wherein each of the reference voltage sources has a reference voltage generation unit, an output transistor, a voltage regulation unit, and an output terminal, the reference voltage generation unit generates a predetermined reference voltage having intrinsic temperature characteristics showing a peak voltage at different temperatures, the output transistor is connected to the output terminal to control an output voltage generated at the output terminal, the voltage regulation unit is connected to the output terminal, the output voltage is formed regulatably so as to become a predetermined reference output voltage, and a voltage detected by the voltage regulation unit is set as a feedback voltage, the output terminals are collectively connected to one common output terminal, and a maximum reference output voltage which is a maximum voltage among the respective reference output voltages is configured to be obtained at the common output terminal, the reference voltage generation unit has a constant current generation unit and a constant voltage generation unit, the constant current generation unit is formed by connecting in series a saturation-connected first MOS transistor and a depletion type second MOS transistor having a gate and a source connected to each other, the constant voltage generation unit is formed by connecting in series a third MOS transistor mirror-connected to the first MOS transistor and a fourth MOS transistor, the output transistor is formed of a fifth MOS transistor having a gate connected between the third MOS transistor and the fourth MOS transistor to become a source follower with respect to the constant voltage generation unit, and the voltage regulation unit is configured to supply the feedback voltage to a gate of the fourth MOS transistor.

2. The reference voltage generation circuit according to claim 1, wherein the constant current generation unit is formed in common for the respective constant voltage generation units by mirror-connecting the first MOS transistor in common to the third MOS transistors of the constant voltage generation units.

3. The reference voltage generation circuit according to claim 1, wherein the voltage regulation unit has one end connected to the output transistor and the output terminal respectively, connected with a plurality of resistive elements in series, and is formed in common for the respective constant voltage generation units and the respective output transistors by being constituted to supply the feedback voltage specified by a division ratio of the resistive elements to a gate of a fourth MOS transistor in a state where the reference output voltage is regulated so as to be generated at the output terminal.

4. The reference voltage generation circuit according to claim 1, wherein a switching element is connected in series with the output transistor and configured to selectively operate the output transistor.

5. The reference voltage generation circuit according to claim 2, wherein the voltage regulation unit has one end connected to the output transistor and the output terminal respectively, connected with a plurality of resistive elements in series, and is formed in common for the respective constant voltage generation units and the respective output transistors by being constituted to supply the feedback voltage specified by a division ratio of the resistive elements to a gate of a fourth MOS transistor in a state where the reference output voltage is regulated so as to be generated at the output terminal.

6. The reference voltage generation circuit according to claim 2, wherein a switching element is connected in series with the output transistor and configured to selectively operate the output transistor.

7. The reference voltage generation circuit according to claim 3, wherein a switching element is connected in series with the output transistor and configured to selectively operate the output transistor.

* * * * *